US006856095B2

(12) United States Patent
Zeng et al.

(10) Patent No.: US 6,856,095 B2
(45) Date of Patent: Feb. 15, 2005

(54) HIGH FREQUENCY HEATING DEVICE

(75) Inventors: JianHong Zeng, Taipei (TW); XingKuan Guo, Taipei (TW); JianPing Ying, Taipei (TW)

(73) Assignee: Delta Electronics, Inc., Taoyuan Shien (TW)

( * ) Notice: Subject to any disclaimer, the term of this patent is extended or adjusted under 35 U.S.C. 154(b) by 0 days.

(21) Appl. No.: 10/611,730

(22) Filed: Jul. 1, 2003

(65) Prior Publication Data

US 2004/0004439 A1 Jan. 8, 2004

(30) Foreign Application Priority Data

Jul. 5, 2002 (TW) ..... 91115023 A

(51) Int. Cl.[7] ..... H01K 1/62

(52) U.S. Cl. ..... 315/70; 315/223; 315/224; 219/760

(58) Field of Search ..... 315/39.51, 39.53, 315/70, 72, 101, 223, 219, 224, 291; 219/702, 715, 760

(56) References Cited

U.S. PATENT DOCUMENTS 3,973,165 A * 8/1976 Hester ..... 315/105
4,812,960 A * 3/1989 Sakamoto et al. ..... 363/20
4,988,922 A * 1/1991 Shoda et al. ..... 315/223
5,053,682 A * 10/1991 Shoda et al. ..... 315/223
5,115,168 A * 5/1992 Shoda et al. ..... 315/223
5,977,530 A * 11/1999 Bessho et al. ..... 219/715
6,362,463 B1 * 3/2002 Bessyo et al. ..... 219/715

* cited by examiner

*Primary Examiner*—Thuy Vinh Tran
(74) *Attorney, Agent, or Firm*—Volpe and Koenig, P.C.

(57) ABSTRACT

This invention provides a magnetron high frequency device which includes: a filtering inductor coupled to a positive end of a direct current power supply; a central tap transformer having a central tap end, a first end and a second end; a filtering capacitor; a first switch which is connected in series to the second end of the central tap transformer and connected to a negative end of the direct current power supply; an in-series circuit having a second switch and a second capacitor and coupled to the central tap transformer; a first capacitor connected in-series with the central tap transformer and connected in parallel with the first switch; a rectifying device coupled to a secondary winding of the central tap transformer; and a magnetron coupled to the rectifying device. The first capacitor, the second capacitor and the central tap transformer forms a resonant circuit.

11 Claims, 22 Drawing Sheets

A

B

A

B

B

A

HIGH FREQUENCY HEATING DEVICE

FIELD OF THE INVENTION

The present invention relates to a high frequency heating device utilizing a magnetron, especially to a structural circuit which drives the magnetron.

BACKGROUND OF THE INVENTION

Please refer to FIG. 1 which is a schematic diagram of a well-known magnetron circuit. As shown in FIG. 1, the magnetron is a vacuum tube for generating microwave. Under its normal working conditions, when its cathode temperature is over 2100° K (absolute temperature), a negative high voltage of several thousand volts is applied between a cathode and a anode of the magnetron. However, different magnetrons have various values of the working voltages. The characteristics of voltage verse current relationship substantially are the similar. As illustrated in FIG. 2, when the voltage between the cathode and the anode reaches to a working voltage, the magnetron emits a microwave. After the voltage between the cathode and the anode is clamped or held to the working voltage, the characteristic of the magnetron is used to be deemed as a voltage stabilizing tube.

Please refer to FIG. 3 which is a circuit schematic diagram of a well-known forward-flyback converter. As illustrated in FIG. 3, the working principle of the well-known forward-flyback converter 100 is as follows: A driving signal of a main switch 101 and an auxiliary switch 102 is a complementary signal. A fifth capacitor 103 is employed in the converter to clampe and control the primary winding voltage of a transformer 104 and to magnetically reset the transformer 104.

Please refer to FIG. 4 which is a circuit waveform schematic diagram of the well-known forward-flyback converter. In FIG. 4, $V_{GS1}$ is a driving signal of the main switch 101, $V_{GS2}$ is a driving signal of auxiliary switch 102, $I_1$ represents a conductive current of the main switch 101, and $I_2$ represents a conductive current of auxiliary switch 102. The advantages of the well-known forward-flyback converter are described as follows: (1) The main switch 101 and the auxiliary switch 102 are turned on by zero-voltage-switch (ZVS), (2) The rectifying diode of the secondary winding is cut off by zero-current-switch (ZCS), there are no reverse recovery problem. The drawbacks of the well-known-forward-flyback converter are described as follows: (1) Because the capacitance of the first filtering capacitor 105 is small, in order to reduce a current ripple of a first filtering inductor 106, the inductance of the first filtering inductor 106 must be enlarged. (2) Because the direct current bias value of the magnetic flux in a high voltage transformer is high, in order to prevent the transformer from operation at saturation state, the air gap in the core of the transformer should increase, therefore, the loss of the transformer increase.

For facilitating understanding the problem of the direct current bias value of the transformer, it is explained as follows: FIG. 5 is a transformer equivalent circuit of the well-known forward-flyback converter. Numeral 107 is an excited inductor of the primary winding of the transformer 104. Because a direct current portion of a current can not flow through a seventh and sixth capacitors 108 and 109, no direct current portion of a current flow through the transformer 104. The mean-square-value current flowing through the excited inductor 106 is equal to $I_{in}$, and an excited current peak value is $I_m$. Assume that the power factor of the power supply is 1, then $i_{in}$, $P_{in}$, $I_m$, $I_{m\ max}$ are calculated in the following equations (1)–(4).

$$i_{in}=I_m \sin \omega t \tag{1}$$

$$P_{in}=V_{in}I_{in}=P_{out}/\eta \tag{2}$$

$$I_m=\sqrt{2}I_{in}=\sqrt{2}P_{out}/V_{in}\eta \tag{3}$$

$$I_{m\ max}=\sqrt{2}I_{in\ max}=\sqrt{2}P_{out\ max}/V_{in\ min}\eta \tag{4}$$

wherein, $i_{in}$ represents an input current.

$P_{in}$ represents an average input power $V_{in}$ represents a mean-square-value of an input voltage $I_{in}$ represents a mean-square-value of an input current $P_{out}$ represents a average output power $\eta$ represents efficiency of a transformer Moreover, a direct current bias peak value of a magnetic potential in the transformer core is illustrated in the following equation (5).

$$U_{dc\ max}=NI_{m\ max} \tag{5}$$

wherein, N represents a coil number of a primary winding

However, the direct current bias value of magnetic potential is very large under conditions of full load and low input voltage. Therefore, the utilization rate of the magnetic core in the transformer is low. Thus, a large air gap must exist in the magnetic core of the transformer. Hence, the loss of the transformer is enlarged.

Therefore, in order to solve the above problem and the drawbacks of prior art, this invention provides a high frequency heating device.

SUMMARY OF THE INVENTION

The main object of the present invention is to provide a magnetron high frequency device which is used to reduce a direct current value in the magnetic flux of a high voltage transformer and to prevent the transformer from operation at saturation state.

It is another object of the present invention to provide a magnetron high frequency device which solves the problem of above direct current bias relating to input current ripples and the transformer in the circuit and which increases the power factor and efficiency of the transformer.

It is another object of the present invention to provide a magnetron high frequency device which increases the utilization rate of the magnetic core of the high voltage transformer in the high frequency heating device.

It is another object of the present invention to provide a magnetron high frequency device whose output rectifying diode can implement zero-current-switch (ZCS) technique and can eliminate the reverse recovery problem of the diode to let the high frequency device obtain higher efficiency and excellent power density.

According to the above technical concept, the magnetron high frequency device includes:

- a filtering inductor coupled to a positive end of a direct current power supply and having a first end and a second end;
- a central tap transformer having a central tap end, a first end and a second end, said central tap end being connected to said second end of said filtering inductor;
- a filtering capacitor a first end of which is connected to said first end of said central tap transformer and a second end of which is connected to a negative end of said direct current power supply;

a first switch which is connected in series to said second end of said central tap transformer and connected to said negative end of said direct current power supply;

an in-series circuit having a second switch and a second capacitor and coupled to said central tap transformer;

a first capacitor connected to said central tap transformer;

a rectifying device coupled to a secondary winding of said central tap transformer; and a magnetron coupled to said rectifying device, Wherein, said first capacitor, said second capacitor and said central tap transformer forms a resonant circuit.

In accordance with the above technical concept, said first capacitor is connected in parallel with said central tap transformer.

Pursuant to the above technical concept, said first capacitor is connected in parallel with said first end and said second end of said central tap transformer.

According to the above technical concept, said first capacitor is connected in-series with said central tap transformer and is connected in parallel with said first switch.

According to the above technical concept, said first capacitor is connected in-series of said second end of said central tap transformer.

In accordance with the above technical concept, said in-series circuit is connected in parallel with said central tap transformer.

Pursuant to the above technical concept, said in-series circuit is connected in parallel with said first end and said second end of said central tap transformer.

According to the above technical concept, said in-series circuit is connected in series with said central tap transformer.

In accordance with the above technical concept, said in-series circuit is connected in series with said second end of said central tap transformer.

Pursuant to the above technical concept, said rectifying device is selected from the group consisted of a full wave voltage doubler rectification, a half wave voltage doubler rectification, a full wave rectification, and a full bridge rectification.

According to the above technical concept, said transformer is a transformer with leakage inductance.

In accordance with the above technical concept, said first capacitor is body capacitance of said first switch.

The present invention may be best understood through the following description with reference to the accompanying drawings, in which:

DETAILED DESCRIPTION OF THE PREFERRED EMBODIMENT

Figure 6:
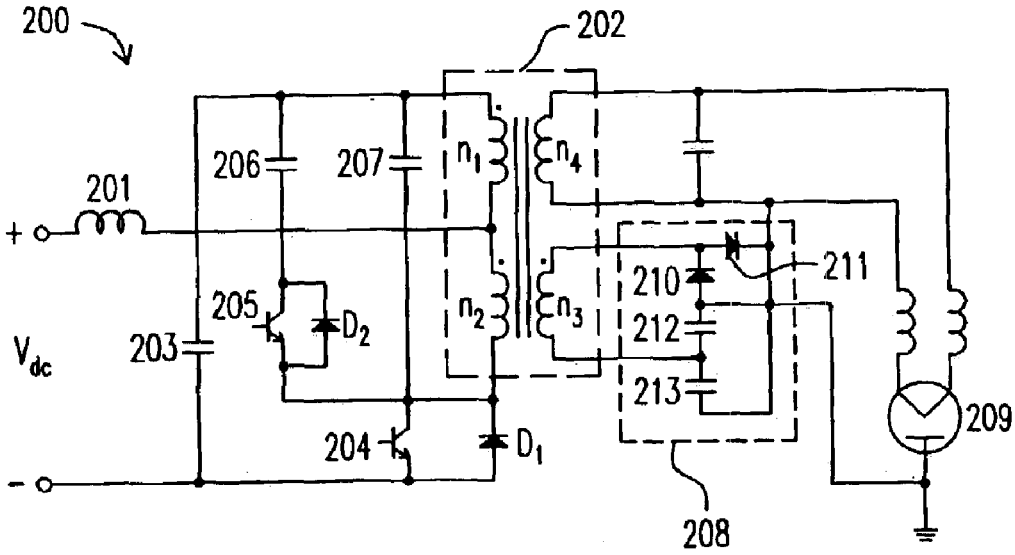
FIG. 6 is a circuit schematic diagram illustrating a DC/DC converter of a first embodiment of the present invention.

Please refer to FIG. 6 which is a circuit schematic diagram illustrating a DC/DC converter of a first embodiment of the present invention, which is a current tapping transformer (CTT) DC/DC transformer. As illustrated in FIG. 6, a high frequency heating device 200 includes a filtering inductor 201, a central tap transformer 202, a filtering capacitor 203, a first switch 204, an in-series circuit including a second switch 205 and a second capacitor 206 connected in-series, a first capacitor 207, a rectifying device 208 and a magnetron 209. The filtering inductor 201 which has a first end and a second end is coupled to a positive end (+) of a direct current power supply $V_{dc}$. The central tap transformer 202 includes a central tap end, a first end and a second end. The central tap end is connected to the second end of the filtering inductor 201. The filtering capacitor 203 has a first end and a second end. The first end of the filtering capacitor 203 is connected to the first end of the central tap transformer 202 and the second end of the filtering capacitor 203 is connected to the negative end (−) of the direct current power supply $V_{dc}$. The in-series circuit is connected in parallel with the central tap transformer 202. The rectifying device 208 is connected to the secondary winding of the central tap transformer 202. The magnetron 209 is connected to the rectifying device 208. The first capacitor 207, second capacitor 206 and the central tap transformer 202 forms a resonant circuit. The rectifying device 208 can be a full wave voltage doubler rectification. The full wave voltage doubler rectification includes first and second diodes 210, 211 and the third and fourth capacitors 212, 213. For a microwave oven, a direct current-direct current converter (DC/DC converter) of a current-type output involves no reverse recovery problem with respect to the rectifying device and is suitable for providing a high voltage output. In the present invention, the structural circuit is applied to the DC/DC converter of a current-type output. The DC/DC converter of the present invention has the advantages of the circuit of FIG. 3 and solves the problem of input ripples and the bias value of the circuit shown in FIG. 3. It can be proved that the power factor and efficiency of the present invention are better than those of FIG. 3.

Figure 7:
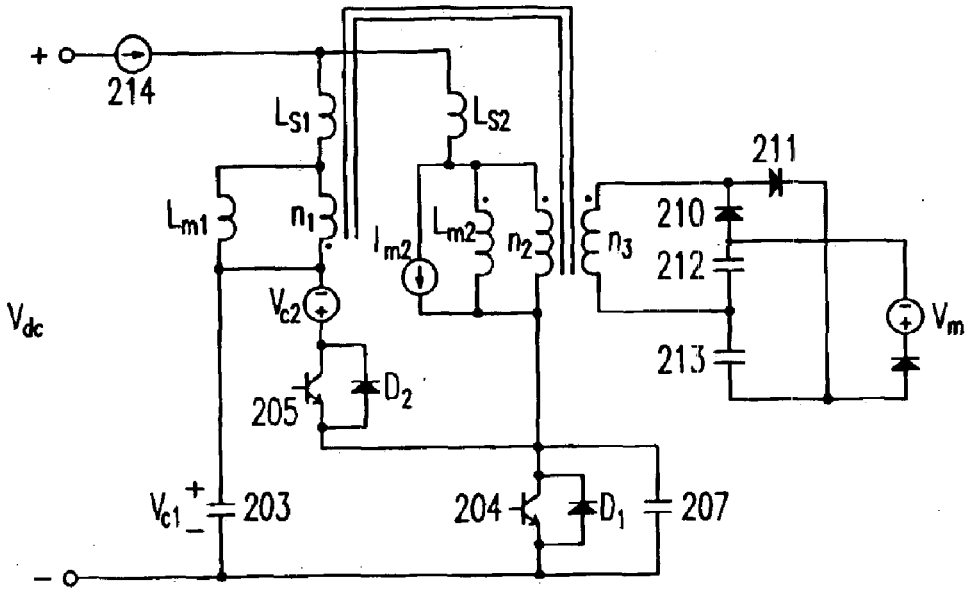
FIG. 7 is a circuit schematic diagram illustrating an equivalent circuit of the DC/DC converter of the first embodiment of the present invention.

Please refer to FIG. 7 which is a circuit schematic diagram illustrating an equivalent circuit of the DC/DC converter of the first embodiment of the present invention. In order to analyze the working principle of the circuit of FIG. 6 and to simplify the circuit, it is analyzed as illustrated in FIG. 7. In one working cycle, we assume as follows: (1) Because the inductance of the filtering inductor 201 is a larger value, we assume it to be equivalent to a current source 214; (2) Because the capacitance of the clamping capacitor (second capacitor) 206 is a larger value, we assume it to be equivalent to a voltage source $V_{c2}$; (3) When the magnetron is operated, its characteristic curve is equivalent to a voltage source $V_m$; (4) A direct current part of a current can not flow through the primary winding n1 of the transformer 202, therefore, all the input direct current part flows through the winding n2. The direct current part can be deemed to be equivalent to a current source $I_{m2}$ with its magnitude of $I_{in}$; (5) After the power consumed at the cathode heating part of the magnetron is compared with the working power, the power consumed is so small that it can be ignored during analysis. Only the secondary winding n3 is needed to be analyzed. $L_{S1}$ and $L_{S2}$ respectively represent leakage inductances of the transformer windings n1 and n2. $L_{m1}$ and $L_{m2}$ respectively represent excited inductances. The first capacitor 207 can be equivalent and connected in parallel with both ends of the main switch 204. The main switch 204 and the auxiliary switch 205 have two parasitizing diode D1, D2. The transformer is a high voltage transformer. In order to have a good insulation, the primary winding and second side winding are separately wound so as to generate a larger leakage inductance. But, the primary winding and the secondary windings can be well coupled so as to ignore the leakage inductance.

In order to further simplify the equivalent circuit of FIG. 7, the secondary winding rectifying circuit of the transformer 202 is simplified as illustrated in FIGS. 8A and 8B. The working procedure of FIG. 8A shows a current in the winding n3 flows in different direction with the results equivalent to a circuit shown in FIG. 8B.

Figure 8:
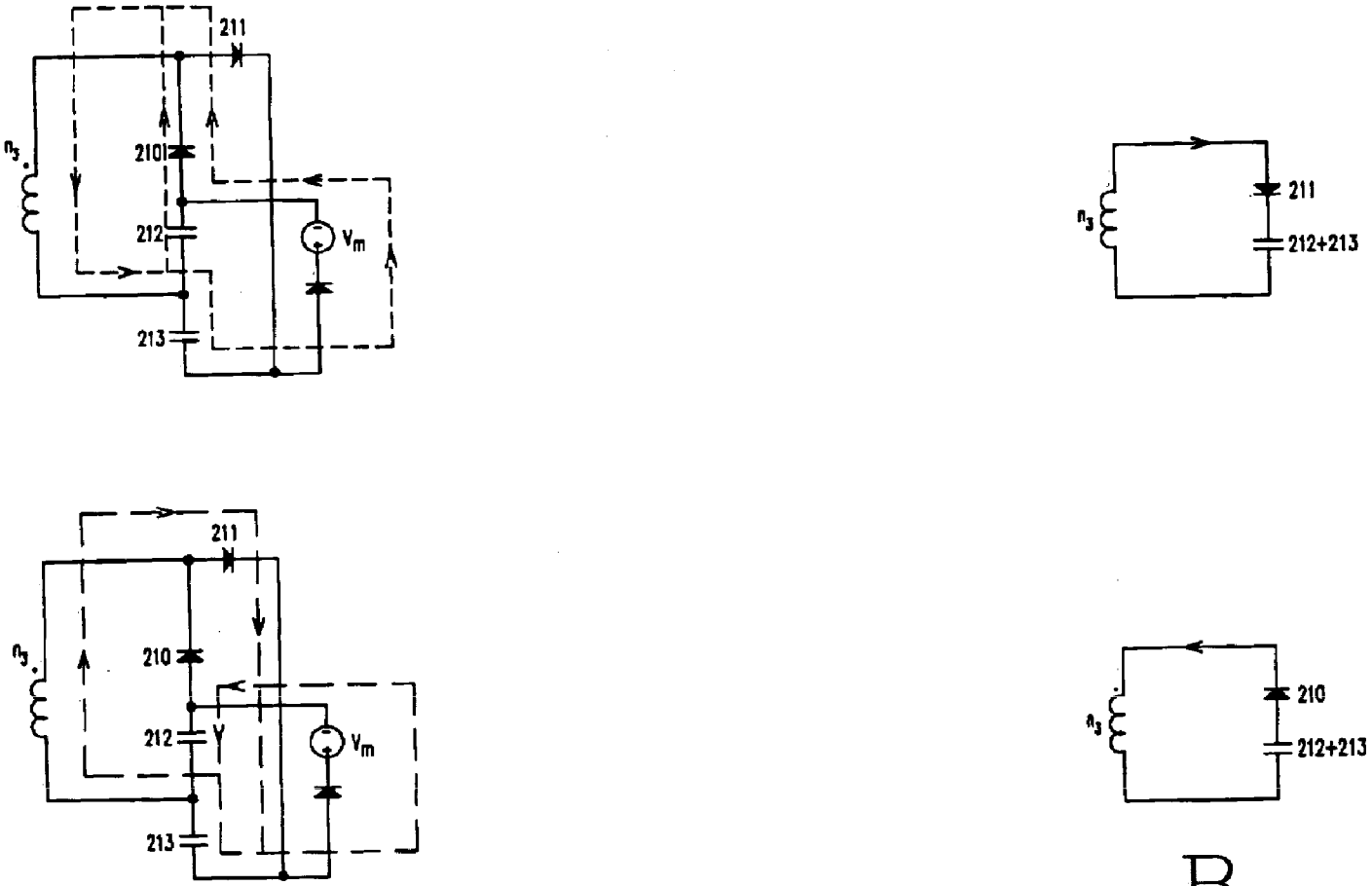
FIG. 8 is a schematic diagram of an equivalent circuit of the secondary winding rectifying circuit of the transformer of FIG. 7.
Figure 9:
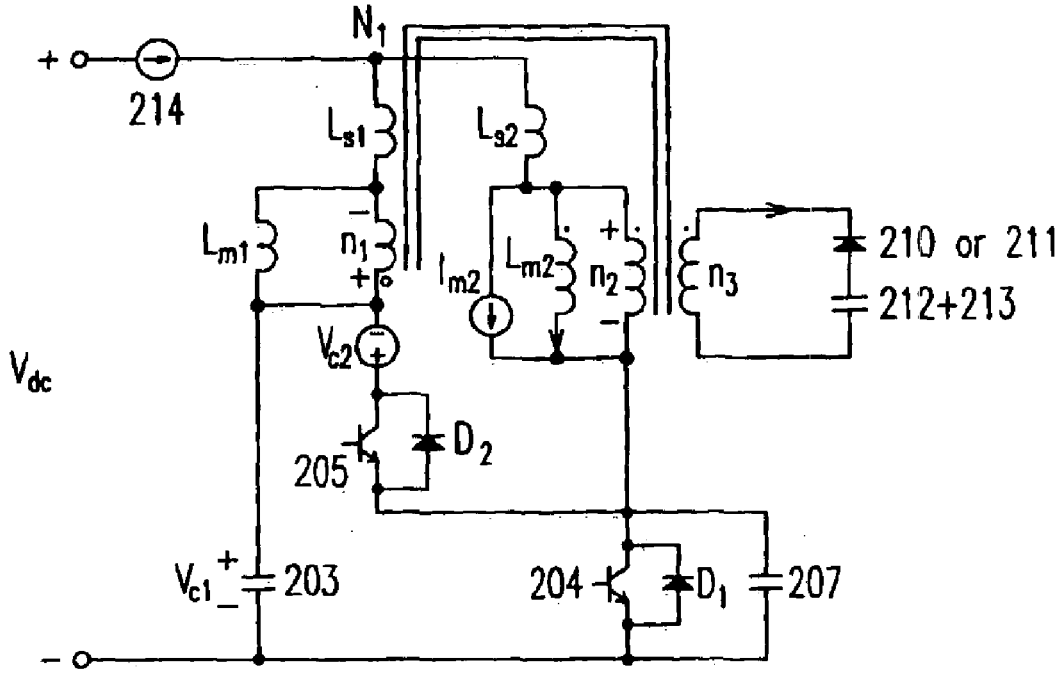
FIG. 9 is an equivalent circuit obtained from simplification according to FIGS. 7 and 8.

The equivalent circuit of FIG. 8 is summed up. An equivalent circuit of FIG. 9 can be obtained after simplification.

Figure 10:
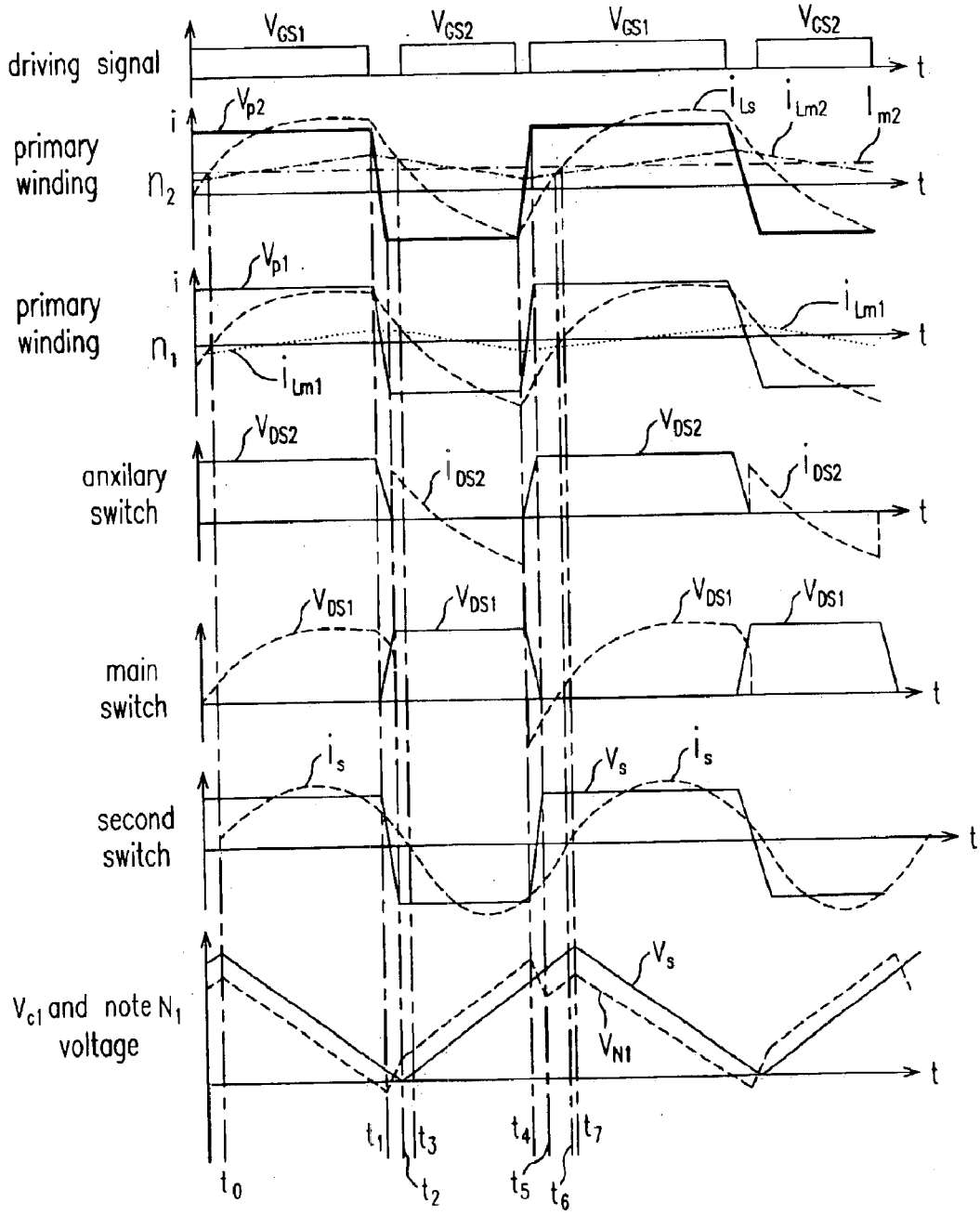
FIG. 10 is a schematic diagram of a circuit waveform of the DC/DC converter of the first embodiment of the present invention.
Figure 11A:
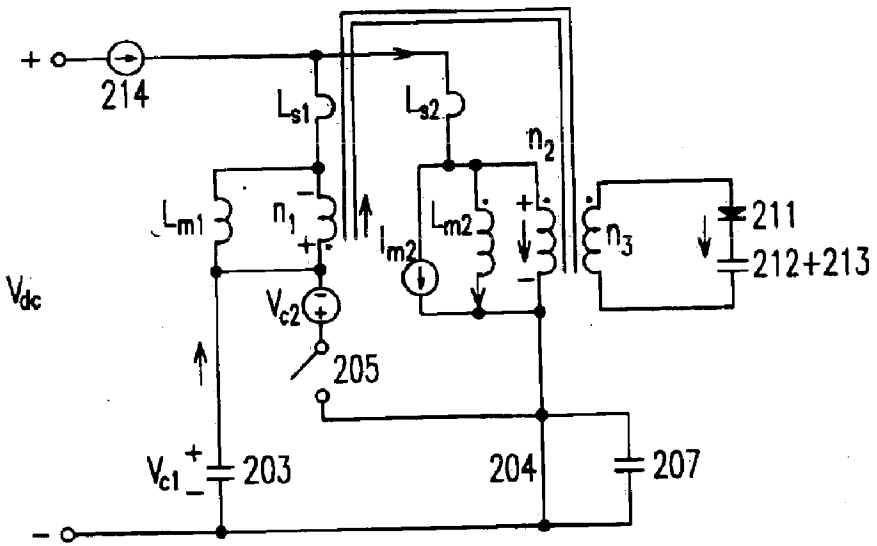
FIGS. 11(*a*)~(*g*) are a circuit driving schematic diagram of the DC/DC converter of the first embodiment of the present invention.
Figure 11A:
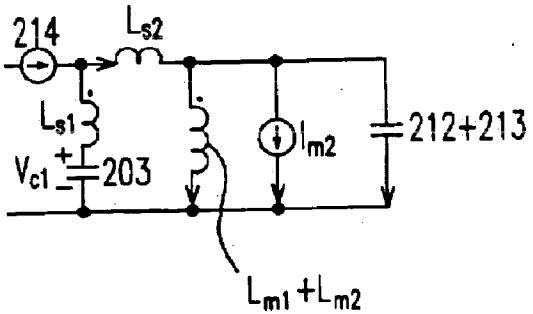
Figure 11B:
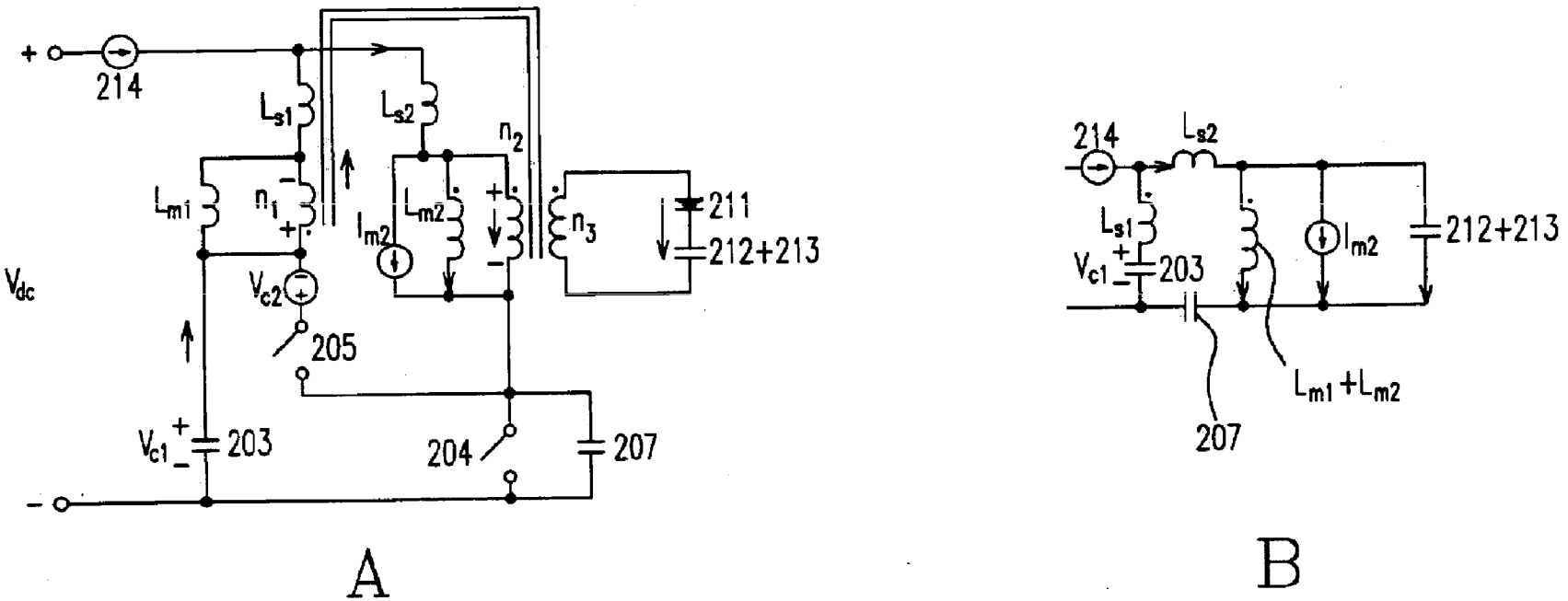
Figure 11C:
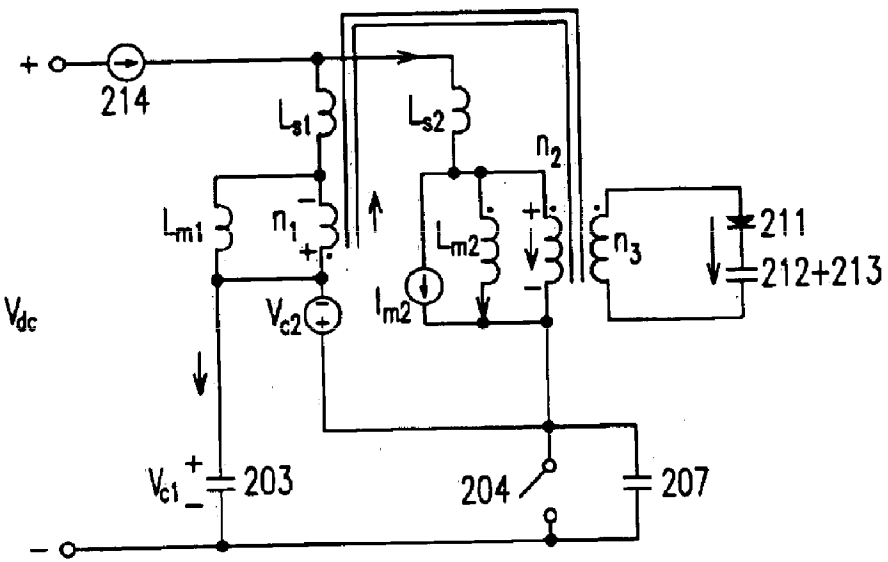
Figure 11C:
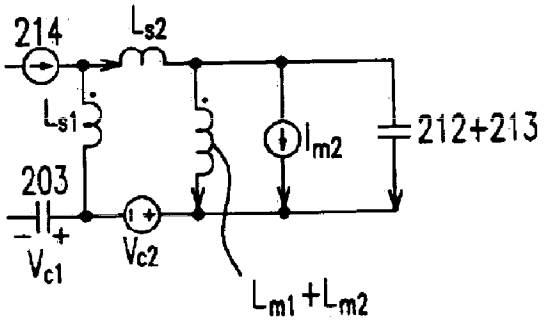
Figure 11D:
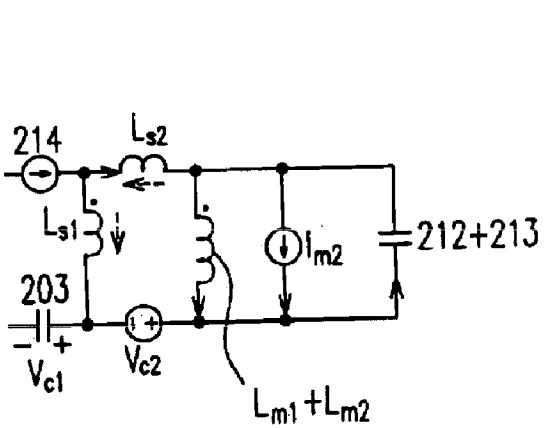
Figure 11D:
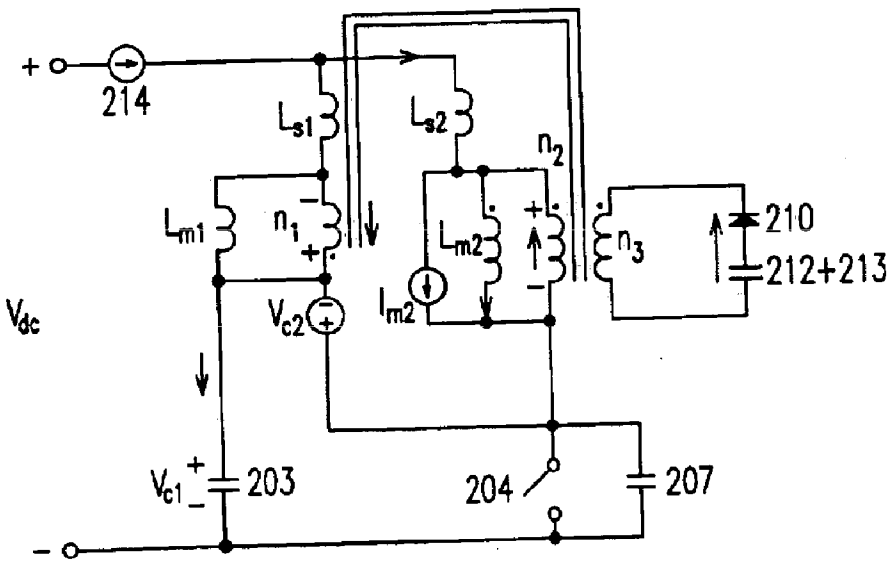
Figure 11E:
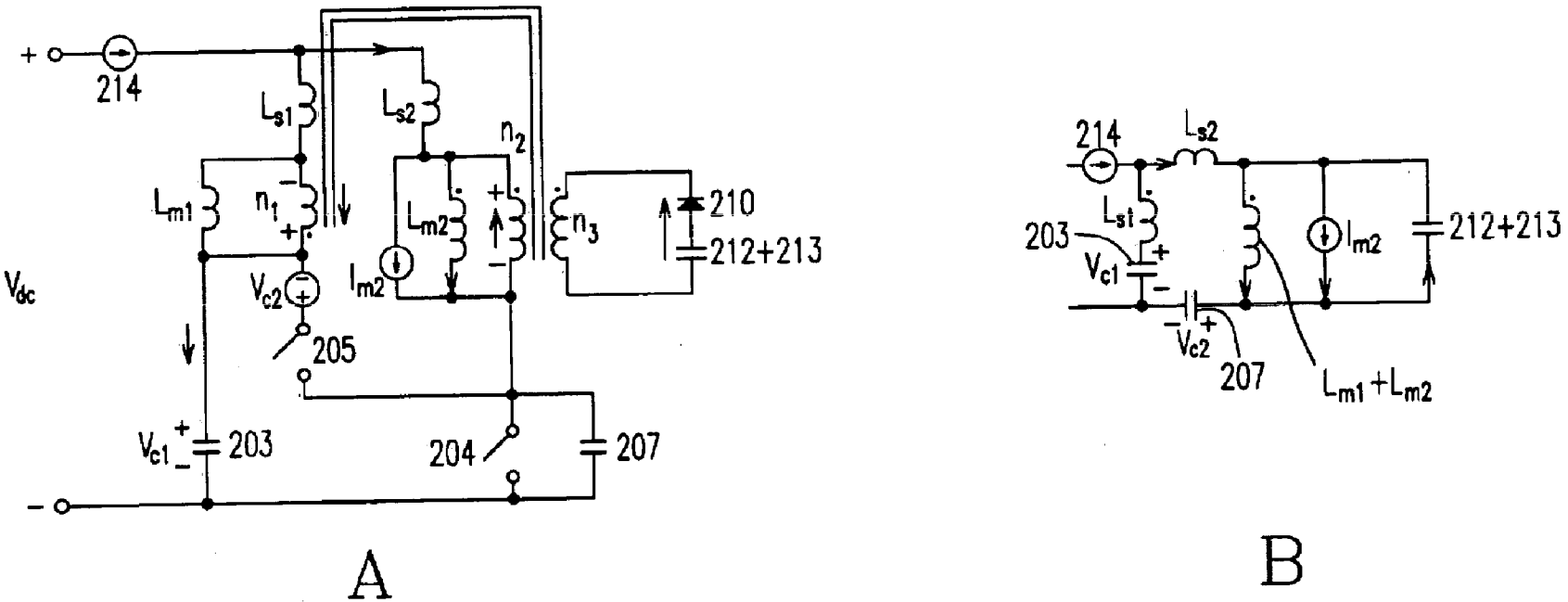
Figure 11F:
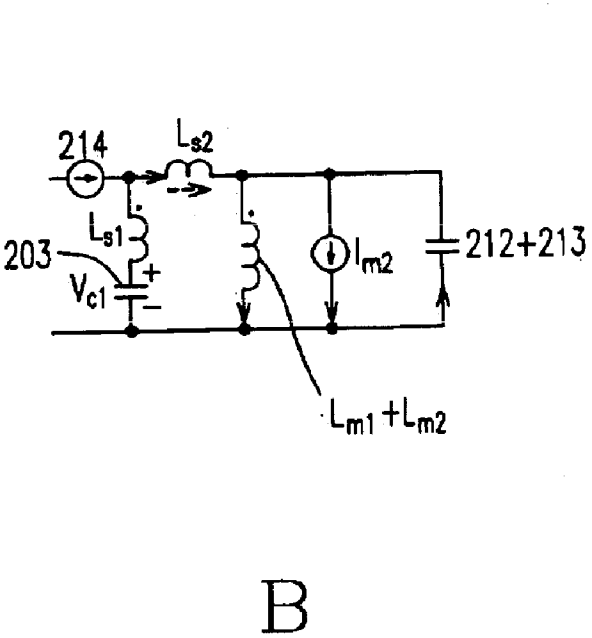
Figure 11F:
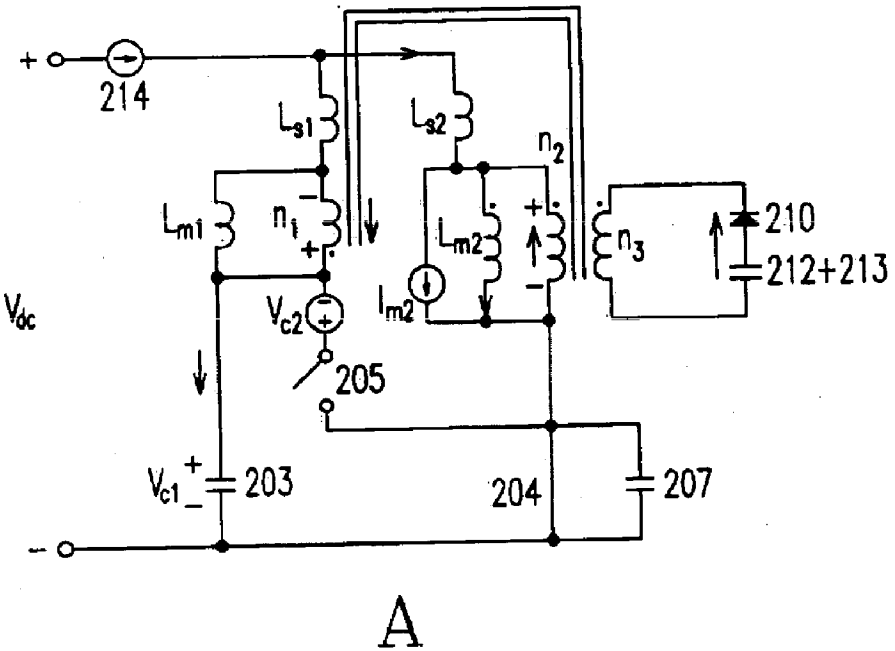
Figure 11G:
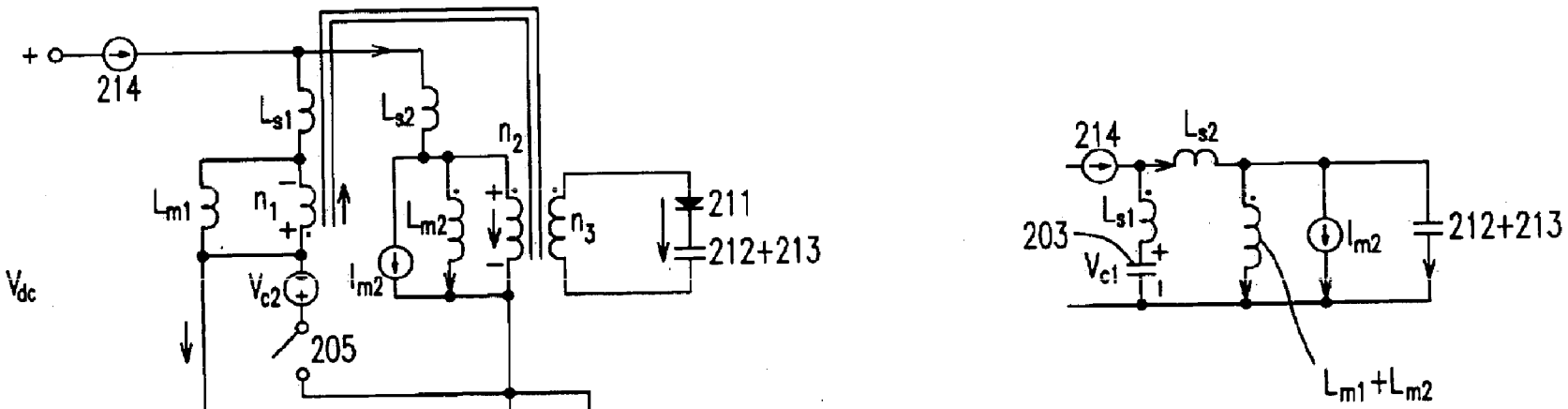

Please refer to FIG. 10 which is a schematic diagram of a circuit waveform of the DC/DC converter of the first embodiment of the present invention wherein $V_{p1}$ is an end voltage of the primary winding n1, $V_{p2}$ is an end voltage of the primary winding n2, $i_{LM1}$ is an excited current of the primary winding n1, $i_{LM2}$ is an excited current of the primary winding n2, $V_{DS1}$ is a crossing voltage crossing the main switch 101, $V_{DS2}$ is a crossing voltage crossing the auxiliary switch 102, $i_{DS1}$ is a current of the main switch 101, $i_{DS2}$ is a current of the auxiliary switch 102, $i_s$ is a current of the secondary winding, $V_s$ is an end voltage of the secondary winding. As illustrated in FIG. 10, the main switch 204 and the auxiliary switch 205 are interactive to complementarily conduct. In one working cycle, the DC/DC converter can have 7 operation modes.

At first, a steady state analysis is carried out with respect to the circuit. With respect to the loop linking from the positive terminal of the direct current power supply $V_{dc}$ (+) to the second filtering inductor 201 to the primary winding n1 to the second filtering capacitor 203 to the negative terminal of direct current power supply $V_{dc}$ (−), because no direct current voltage portion of a current can flow through the second filtering inductor 201 and the primary winding n1, the direct current voltage $V_{C1}$ at the second filtering capacitor 203 is equal to input voltage $V_{dc}$ ($V_{dc}$ is a rectified voltage of sine wave of 120 Hz). Due to a smaller value of the capacitance of the second filtering capacitor 203, $V_{C1}$ actually is a half sine wave at a frequency of 120 Hz. Because the $V_{C1}$ is connected with a high frequency inverter portion, it generates a large voltage ripple.

With respect to the loop linking from positive terminal $V_{dc}$ (+) of the DC power supply to the second filtering inductor 201 to the secondary winding n2 to the main switch 204 to negative terminal $V_{dc}$ (−), we assume that the duty ratio of the main switch 204 is $D_{Q1}$. Because Volt verse Sec relationship from a magnetic component of the second filtering inductor 201 to the secondary winding n2 must reach equilibrium, the voltage during a cut-off period of the main switch 204 relates to a relationship between the voltage $V_{C2}$ at the second capacitor 206 and the input voltage, i.e. an output voltage verse an input voltage relationship in a boost circuit as shown in the following equation (6):

$$V_{c2} = \frac{V_{dc}}{1 - D_{Q1}} \tag{6}$$

After the node N1 is analyzed, it can be inferred that the DC current portion $I_{m2}$ is equal to $I_{in}$. Because the windings n1 and n2 are wound on the same magnetic circuit and the phase of the windings n1 and n2 are the same, we can infer the following equations (7) and (8).

$$I_{Lm1}=I_{Lm2}-I_{m2} \tag{7}$$

$$I_{n1}=I_{n2} \tag{8}$$

Please refer to FIGS. 11(*a*)–11(*g*) which illustrate a circuit driving schematic diagram of the DC/DC converter of the first embodiment of the present invention. The main working principle of FIGS. 11(*a*)–11(*g*) are explained as follows:

Mode 1 ($t_0$–$t_1$): As shown in FIG. 11(*a*), the main switch 204 is turned on and the auxiliary switch 205 is turned off and the energy stored in the second filtering capacitor 203 is transferred to the secondary winding, in that case, $i_{LS}>I_{in}$. The input current $I_{in}$ is stored as magnetic energy in the transformer in order to be fundamental step to continuously transfer energy to the secondary winding after the main switch 204 is cut off. At this time, the equivalent circuit is illustrated in FIG. 11(*a*)B. After analysis, the following equations (9)–(13) are inferred.

$$i_{Ls} \geqq I_{m2}=I_{in} \tag{9}$$

$$i_{Lm1} = i_{Lm1t0} + \frac{\int_{t0}^{t1} u_{c1}\,dt}{L_{m1} + L_{m2} + L_s} \tag{10}$$

$$u_{c1} = u_{c1t0} - \frac{\int_{t0}^{t1} (i'_s + i_{Lm1})\,dt}{C_1} \tag{11}$$

$$i'_s = i'_{st0} + \frac{(u_{c1t0} - u'_{(c5+c6)t0})}{\sqrt{\frac{L_s}{C1\,//\,(C5+C6)'}}} \sin\omega_0 t \tag{12}$$

$$\omega_0 = 1/2\pi\sqrt{L_s(C1//(C5+C6)')} \tag{13}$$

wherein, $C_1$ is a capacitance of the second filtering capacitor 203

$C_5$ is a capacitance of the third capacitor 215

$C_6$ is a capacitance of the fourth capacitor 213

$u_{c1}$ is a end voltage of the second filtering capacitor 203, i.e. it is proportional to a current calculated by equivalent circuit from the secondary winding to the primary winding as a difference between a current flowing through the winding n1 and the current $i_{LM1}$ $(C_5+C_6)'$ is a capacitance calculated by equivalent circuit from the capacitances of the capacitors 212, 213 at secondary winding to capacitance of transformer primary winding $C_1//(C_5+C_6)'$ is a capacitance calculated by equivalent circuit to the filtering capacitor 203 connected in parallel with the capacitors 212, 213

$u'_{(C5+C6)}$ is a voltage calculated by equivalent circuit from transformer secondary winding to primary winding $L_S$ is the sum of the leakage inductances $L_{S1}$ and $L_{S2}$ Mode 2 (t1–t2): As shown in FIG. (b)A, the main switch 204 is cut off and the auxiliary switch 205 is turned off. Because the current in the inductance $L_S$ can not change abruptly, the first capacitor 207 continuously is charged until the voltage of the first capacitor 207 reaches to the clamping voltage $V_{C2}$. Under this operation mode, energy is continuously transferred from the primary winding to the secondary winding. The magnetic energy stored in transformer reaches to a maximum value. Under this operation, the time or duration is very short, so it is assumed that the excited current $i_{Lm}$ ($i_{Lm}=i_{Lm1}+i_{Lm2}$) is not changed, the voltage levels of the second filtering capacitor 203, and the voltage levels of the equivalent capacitor (C5+C6)' for the secondary winding capacitors 212 and 213 are not changed because the capacitances of the secondary winding capacitors 212 and 213 is larger than the capacitance of the first capacitor 207 which is deemed as being reasonable. The voltage level at the first capacitor 207 changes from zero to positive value of $V_{c2}+u_{c1t1}$. It is assumed that the function of the voltage level affecting $i_S$ is that it equal to an equivalent circuit when the voltage level is equal to $(V_{C2}+u_{C1t1})/2$. The equivalent circuit is shown in FIG. 11(*b*)B from which the following equations (14)–(17) are derived.

$$Lm\ 1s1 = Lm\ 1t2 \tag{14}$$

$$u_{c1} = u_{c1t1} \tag{15}$$

$$i'_s = i'_{st1} - \frac{\left(u'_{(C5+C6)t1} + \frac{1}{2}V_{c2} - \frac{1}{2}u_{c1t1}\right)t}{L_s} \tag{16}$$

$$T_{12} \approx \frac{(V_{c2} + u_{c1t1})C_3}{I_{m2} + \frac{i'_{st1} + i'_{st2}}{2}} \tag{17}$$

Mode 3 (t2–t3): As shown in FIG. 11(*c*)A, when the first capacitor 207 is charged to a pre-determined value, the parasitizing diodes of the main switch 204 is turned on. The turning on the parasitizing diodes create a conductive environment for zero-voltage-switch conduction of the auxiliary switch 205. Because the energy of the leakage inductance is larger (at this time, the current of the inductance $L_S$ is bigger than that of the excited current), the energy is transferred toward the secondary winding. Because the time duration is shorter, it is assumed the voltage of the capacitance (212+213)' is not changed. Its equivalent circuit is illustrated in FIG. 11(*c*)B from which the following equations (18)–(21):

$$i_{Lm1} = i_{Lm1t2} - \frac{V_{C2}t}{L_{m1} + L_{m2} + L_s} \tag{18}$$

$$u_{c1} = u_{c1t2} - \frac{I_{m2}t}{C_1} \tag{19}$$

$$i'_s \approx i'_{st2}\cos\omega_1 t + \frac{V_{C2} - u'_{(c5+c6)}}{\sqrt{\frac{L_s}{(C5+C6)'}}} \sin\omega_1 t \tag{20}$$

$$\omega_1 = \frac{1}{2\pi\sqrt{L_s(C5+C6)'}} \tag{21}$$

Mode 4 ($t_3$–$t_4$): As illustrated in FIG. 11(*d*), at time $t_3$, the current in inductance $L_S$ is smaller than the excited current and the current in the secondary winding reduces to zero value. Therefore, the cut-off or turning-off of the diode at the secondary winding belongs to zero-current-switch cut-off. After the direction of the current changes, the energy stored in inductance $L_S$ continuously provides energy to the second capacitor 206. Under this operation mode, the equivalent circuit is illustrated in FIG. 11(*d*)B from which the following equations (22)–(24) are inferred.

$$i_{Lm1} = i_{Lm1t3} - \frac{V_{C2}t}{L_{m1} + L_{m2} + L_s} \tag{22}$$

$$u_{c1} = u'_{c1t3} + \frac{I_m t}{C_1} \tag{23}$$

$$i'_s = \frac{(C5+C6)'}{L_s} V_{c2}^2 \sin\omega_1 t \tag{24}$$

Mode 5 ($t_4$–$t_5$): As illustrated in FIG. 11(*e*)A, the current flowing through the auxiliary switch 205 and the inductance LS can not change abruptly and is under resonance oscillation with the first capacitor 207 so as to let the second filtering capacitor 203 discharge. Its equivalent circuit is illustrated in FIG. 11(*e*)B. Because the operation duration of the Mode 5 is shorter and is similar to the Mode 2. Therefore, it is assumed that the current $i_{LM}$ is not changed, and that the voltages at the second filtering capacitor 203 and the capacitor (212+213)' are not changed (because the capacitances of the two capacitors are larger than that of the first capacitor 207. Thus, the assumption is reasonable.), and that the voltage level at the first capacitor 207 changes from $V_{C2}+u_{c1t1}$ to zero value. From the above descriptions, the following equations (25)–(28) is inferred.

$$i_{Lm\ 1t4}=i_{Lm\ 1t5} \tag{25}$$

$$u_{c1}=u_{c1t4} \tag{26}$$

$$i'_s = i'_{st4} - \frac{\left(u'_{(C5+C6)} - \frac{1}{2}V_{c2} + \frac{1}{2}u_{c1t4}\right)t}{L_s} \tag{27}$$

$$T_{45} \approx \frac{(V_{c2} + u_{c1t4})C_3}{I_{m2} + \frac{i'_{st4} + i'_{st5}}{2}} \tag{28}$$

Mode 6 ($t_6$–$t_7$): As illustrated in FIG. 11(*f*), the turning on or conduction of the body diode of the main switch 204 creates a favorable condition of zero-voltage-switch (ZVS) conduction. The current in the inductance $L_S$ is larger than excited current. Therefore, energy is transferred to the secondary winding. At this time, the following equations (29)–(31) are obtained.

$$i_{Lm1} = i_{Lm1t5} + \frac{\int_{t5}^{t6} u_{c1}\,dt}{L_{m1} + L_{m2} + L_s} \tag{29}$$

$$u_{c1} = u_{c1t5} - \frac{\int_{t5}^{t6} (i'_s + i_{Lm1})\,dt}{C_1} \tag{30}$$

$$i'_s \approx i'_{st5}\cos\omega_0 t - \frac{V_{C2} - u'_{(C5+C6)}}{\sqrt{\frac{L_s}{C_1 // (C5+C6)'}}}\sin\omega_0 t \tag{31}$$

Mode 7 ($t_6$–$t_7$): As shown in FIG. 11(*g*)A, at time $t_6$, the current in the inductance $L_S$ is smaller than the excited current. The current in the secondary winding decreases to zero value. Therefore, the turning off or cut-off of the diode at the secondary winding is zero-current-switch (ZCS) cut-off. After the current changes its direction, the energy stored in the inductance $L_S$ continuously transferred to the second capacitor 206. Under the operation mode, its equivalent circuit is shown in FIG. 11(*g*)B from which the following equations (32)–(35) are inferred.

$$i_{Lm1} = i_{Lm1t6} + \frac{\int_{t6}^{t7} u_{c1}\,dt}{L_{m1} + L_{m2} + L_s} \tag{32}$$

$$u_{c1} = u_{c1t6} + \int_{t6}^{t7} (i'_s + i_{Lm1})\,dt \tag{33}$$

$$i'_s = \frac{(C5+C6)'}{L_s} V_{c2}^2 \sin\omega_1 t \tag{34}$$

$$\omega_1 = \frac{1}{2\pi\sqrt{L_s(C5+C6)'}} \tag{35}$$

After the operation of Mode 7 is over, the status of the circuit returns to the Mode 1.

Figure 12:
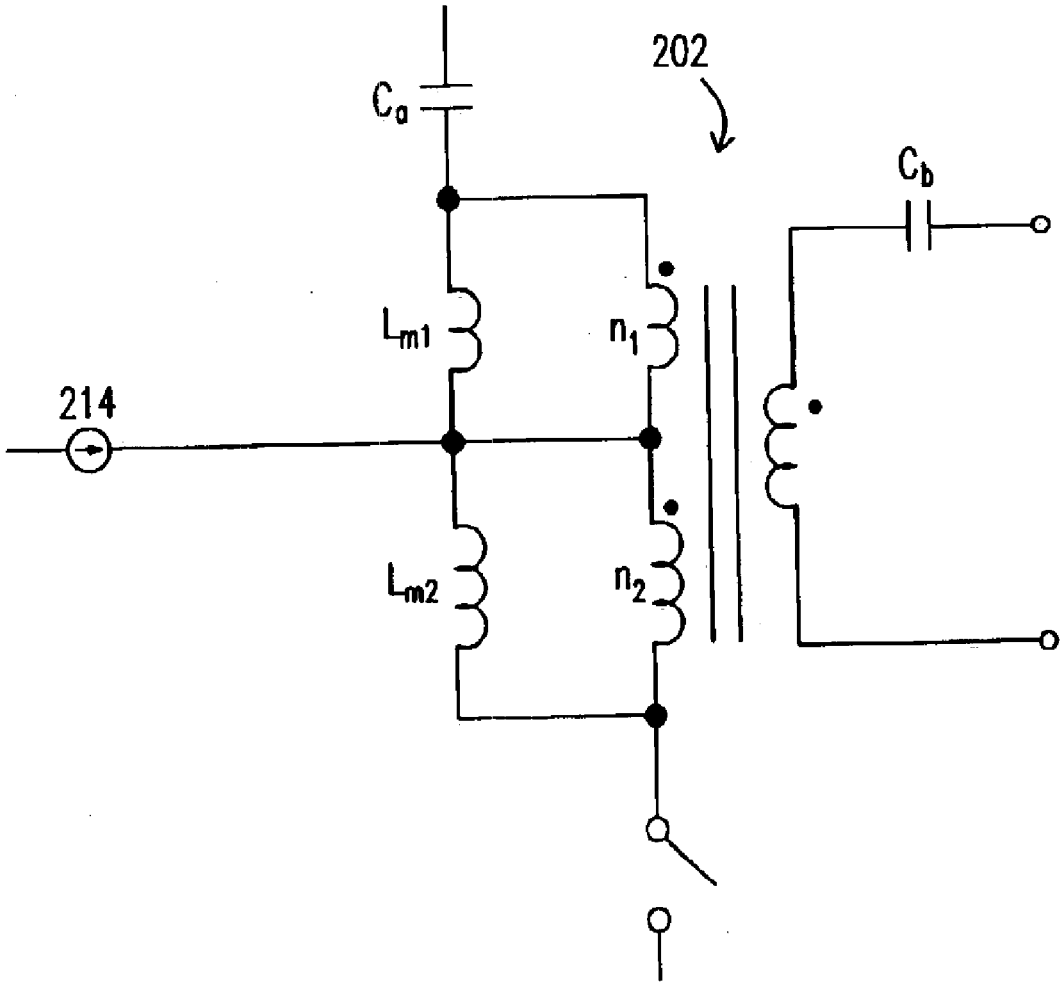
FIG. 12 is an equivalent circuit of the DC/DC converter of the first embodiment of the present invention.

With respect to the DC magnetic bias, it is analyzed as follows:

In the circuit, for the primary winding and secondary winding of the transformer, no DC magnetic bias exists in the winding n1 while DC magnetic bias exists in the winding n2. For facilitating the analysis, an analysis model of the transformer 202 is shown in FIG. 12 in which $L_{m1}$ and $L_{m2}$ are respectively the excited inductances of the primary windings n1 and n2 of the transformer 202. Because no DC current portion can flow through the capacitor $C_a$ and $C_b$, the DC current portion at $L_{m2}$ is equal to the input DC current portion. It is assumed that the power factor of the power supply is 1. Then, the following equations (36)–(39) are obtained.

$$i_{in}=I_m \sin \omega t \tag{36}$$

$$P_{in}=V_{in}I_{in}=P_{out}/\eta \tag{37}$$

$$I_m=\sqrt{2}I_{in}=\sqrt{x}\sqrt{2}P_{out}/\eta V_\eta \tag{38}$$

$$I_{in\ max}=\sqrt{2}I_{in\ max}=\sqrt{2}P_{out\ max}/V_{in\ min}\eta \tag{39}$$

The DC bias peak value of the magnetic potential in the magnetic core of the transformer is as follows:

$$U_{dc\ max-n}2I_{m\ max} \tag{40}$$

$$U_{dc\ max}=NI_{in\ max}=(n2+n1)I_{m\ max} \tag{41}$$

After the DC bias peak values of the magnetic potentials in the magnetic cores of the two transformers between the prior art and the present invention are compared, the DC bias peak value of the present invention is smaller (depending upon the design). The present invention increases the core utilizing rate of the transformer, decreases the gas gap of the magnetic core and reduces the loss of the transformer.

Figure 13:
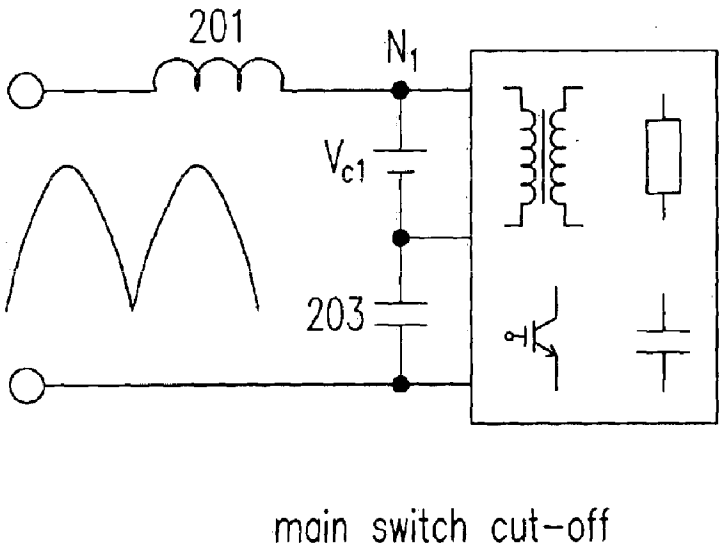
FIG. 13 is an equivalent analysis circuit of the first embodiment of the present invention.
Figure 13:
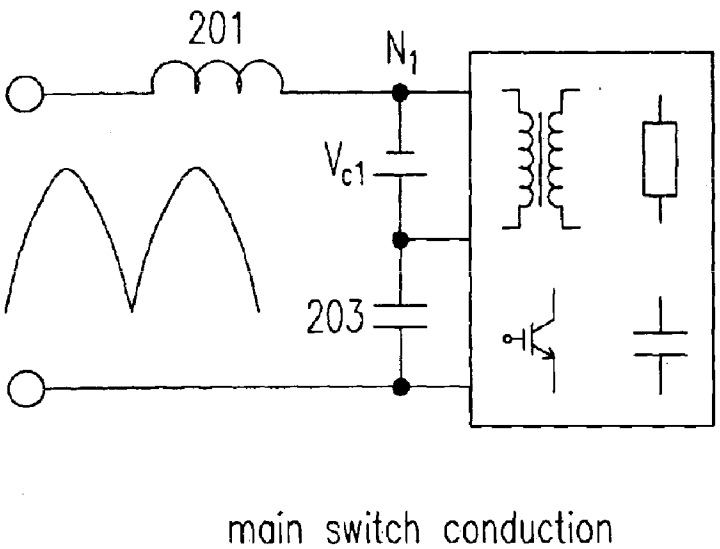
Figure 14:
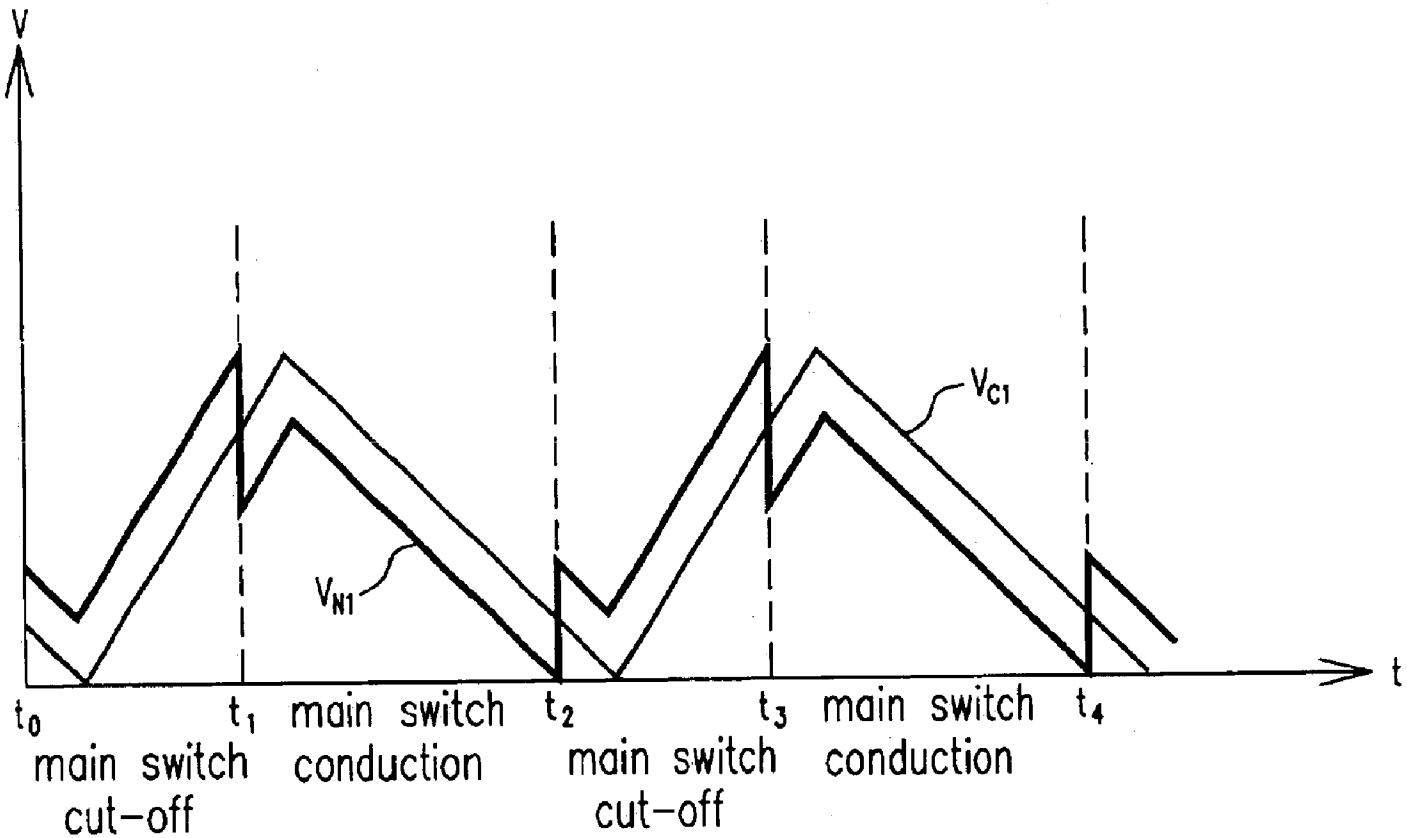
FIG. 14 is a schematic diagram illustrating a voltage waveform of the node N1 voltage and filtering capacitor voltage Vc1 of the DC/DC converter of the first embodiment of the present invention.

The input current ripple is analyzed as follows: In order to construct and analyze the analysis model as shown in FIG. 13 in which the voltage $V_1$ is a voltage in the transformer winding n1. From the analysis of the magnetic circuit, it is known that when the main switch 204 is turned on, the voltage at node N1 is equivalent to a sum of a voltage of the second filtering capacitor 203 and a voltage of $V_{c1}$. When the main switch 204 is turned off, the voltage at node N1 is equivalent to a sum of a voltage of the second filtering capacitor 203 and a voltage of $V_{c1}$ as illustrated in FIG. 13. From FIG. 14, after reviewing a correctly selected winding n1, a voltage ripple waveform of two peaks is obtained at the node N1. Its effect is equivalent to a double frequency applied to a rear stage high frequency inverter. Therefore, the input current ripple is greatly reduced and the input power factor of the power supply increases.

Figure 1:
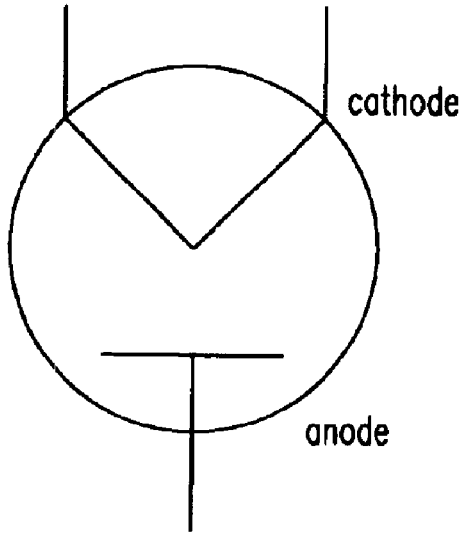
Fig. 1(PRIOR ART)
FIG. 1 is a circuit schematic diagram illustrating the conventional magnetron of a prior art.
Figure 2:
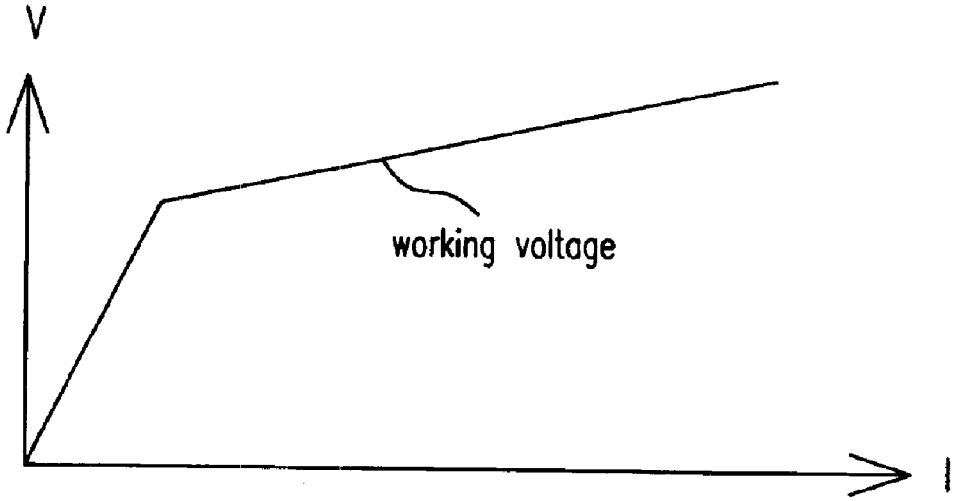
Fig. 2(PRIOR ART)
FIG. 2 is a schematic diagram illustrating the conventional voltage verse current characteristic curve of a magnetron of prior art.
Figure 3:
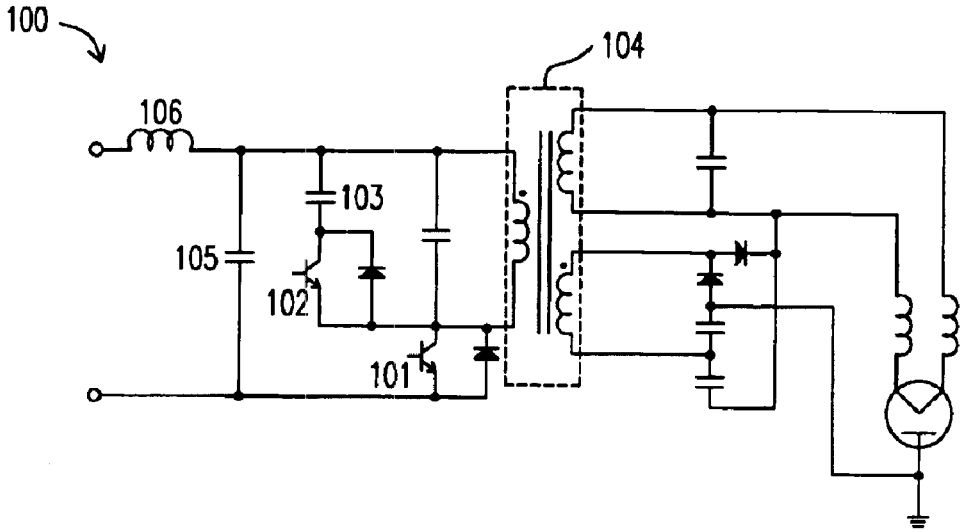
Fig. 3(PRIOR ART)
FIG. 3 is a circuit schematic diagram illustrating a well-known forward-flyback converter.
Figure 4:
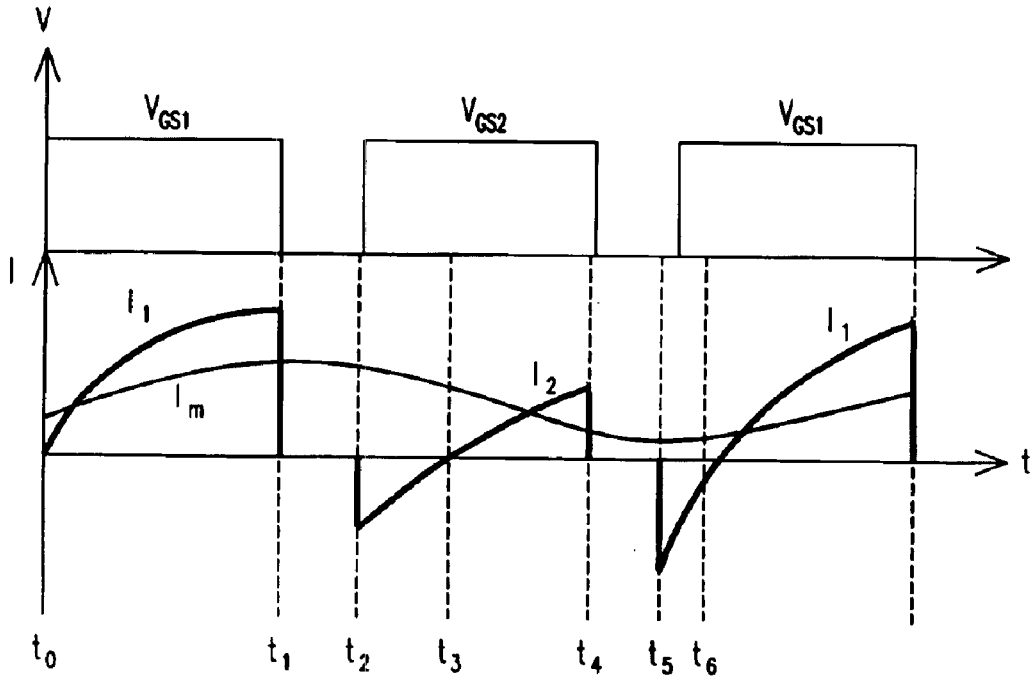
Fig. 4(PRIOR ART)
FIG. 4 is a schematic diagram illustrating a circuit waveform of the well-known forward-flyback converter.
Figure 5:
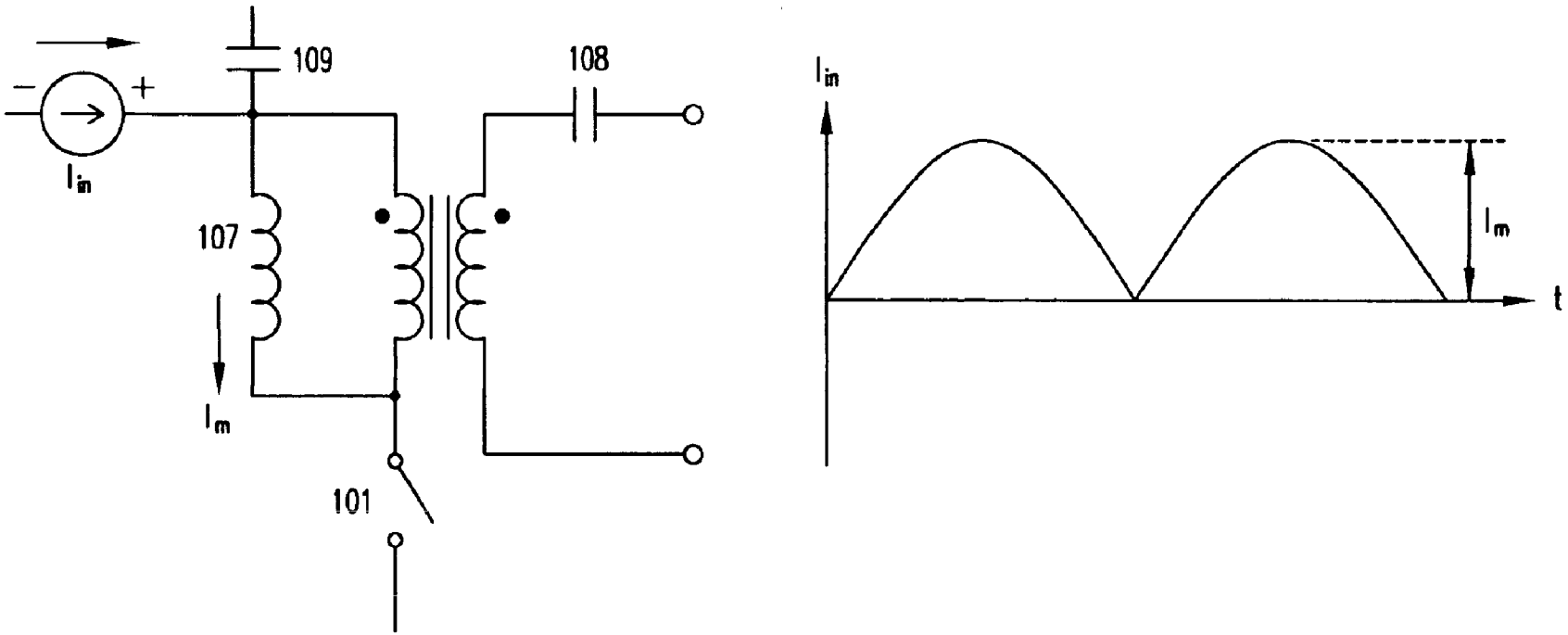
Fig. 5(PRIOR ART)
FIG. 5 is a schematic diagram illustrating an equivalent circuit of the well-known forward-flyback converter.

From the above analysis, the present invention has the following advantages:

(1) Because the input current is of a continuously conductive type and the filtering inductor is connected to the filtering capacitor through the winding n1, the current ripple is smaller in comparison with it shown in FIG. 3 (At the same ripple conditions, the input filtering inductance may be decreased). Therefore, the power factor is higher.

(2) No DC bias value exists in the winding n1 and the DC current portion passes through the winding n2 only. Therefore, the bias magnetic potential of the magnetic core is smaller than that of FIG. 3. The utilizing rate of the magnetic core of a high voltage transformer increases.

(3) The main power component and the auxiliary power component can implement a zero-voltage-switch when turned on. When cut-off, after the buffering of the first capacitor 207, the switch loss is smaller. The outputting rectifying diode can implement a zero-current-switch, thus, the reverse recovery problem is solved and a higher efficiency and power density of a device is obtained.

Figure 15:
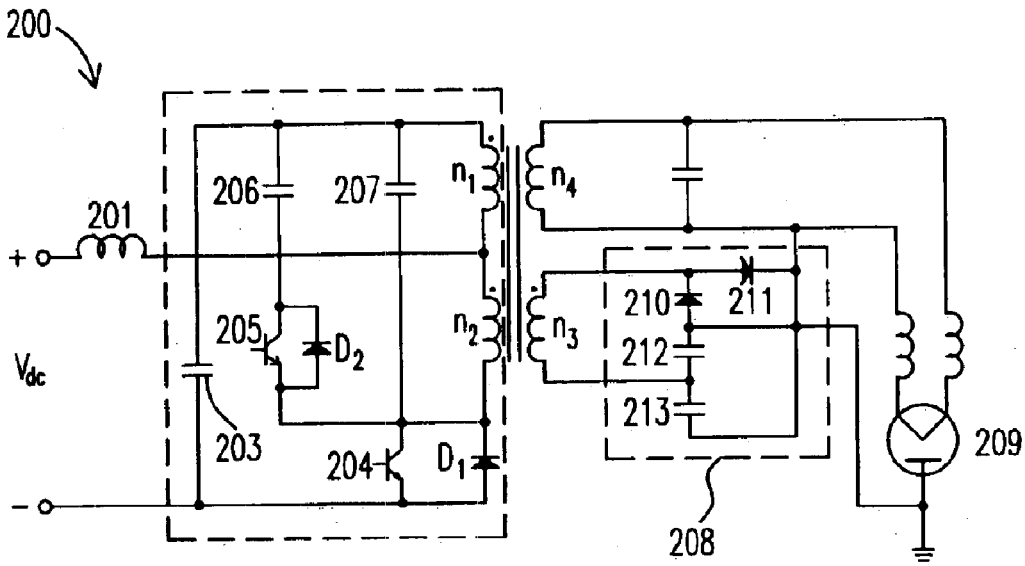
FIG. 15 is a circuit schematic diagram illustrating an inverter portion and a rectification portion of the DC/DC converter of the first embodiment of the present invention.

However, the above analysis is accomplished through example by the circuit shown in FIG. 6. The circuit has the following equivalent modification. In order to clearly explain, the circuit illustrated in FIG. 6 is divided into two parts as shown in FIG. 15, i.e. a first portion is an inverter portion and a second portion is a rectifying portion.

(1) Equivalent Modification Working Examples of the First Portion

Figure 16:
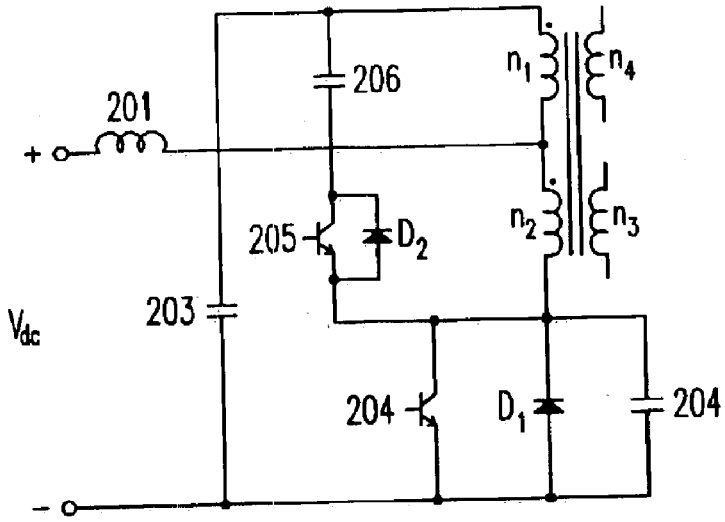
FIG. 16 is circuit schematic diagram of part of the DC/DC converter of the second embodiment of the present invention.

The second embodiment: When the first capacitor 207 is connected parallel with the primary winding of the transformer, it equivalent to a circuit in which the first capacitor 207 is connected in parallel with the ends of the switch 204, or a circuit in which a body capacitor of the main switch 204 substitutes the first capacitor 207 as shown in FIG. 16.

Figure 17:
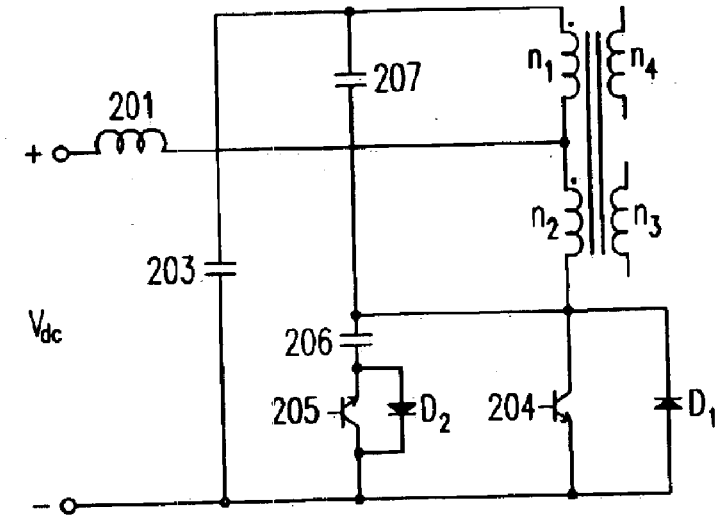
FIG. 17 is circuit schematic diagram of part of the DC/DC converter of the third embodiment of the present invention.

The third embodiment: The in-series circuit of the second capacitor 206 and the auxiliary switch 205 is coupled in parallel with the primary winding of the transformer so as to absorb the current and to reset the transformer. Its equivalent circuit is that the in-series circuit of the second capacitor 206 and the auxiliary switch 205 is coupled in parallel with the ends of main switch 204 as shown in FIG. 17. The auxiliary switch 205 can be driven by use of a p-channel IGBT or MOS.

Figure 18:
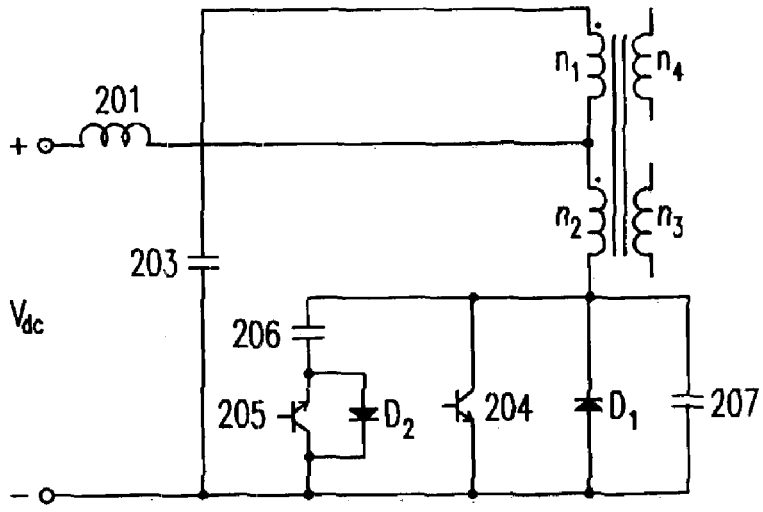
FIG. 18 is circuit schematic diagram of part of the DC/DC converter of the fourth embodiment of the present invention.

The fourth embodiment: The above two equivalent rules are summed up and combined: When the first capacitor 207 is connected in parallel with the primary winding of the transformer, it equivalent to a circuit in which the first capacitor 207 is connected in parallel with the ends of the switch 204 or a circuit in which a body capacitor of the main switch 204 substitutes the first capacitor 207. The in-series circuit of the second capacitor 206 and the auxiliary switch 205 is coupled in parallel with the ends of main switch 204 as illustrated in FIG. 18.

(2) Equivalent Modification Working Examples of the Second Portion

Figure 19:
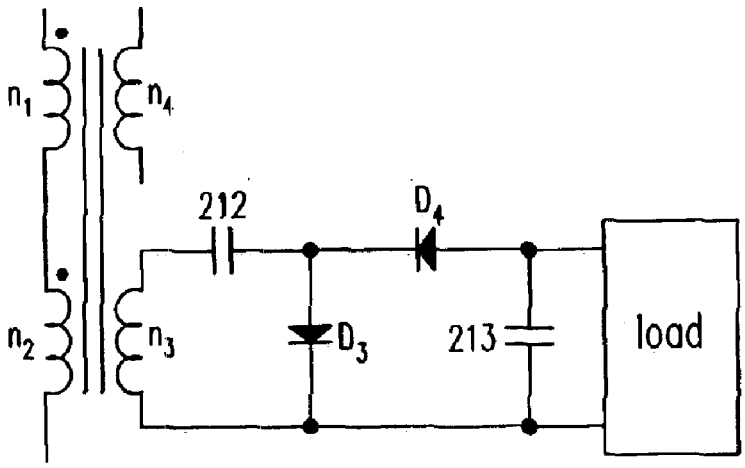
FIG. 19 is circuit schematic diagram of part of the DC/DC converter of the fifth embodiment of the present invention.

The fifth embodiment: The second portion of FIG. 16 is a full wave voltage doubler rectification. If a half wave voltage doubler rectification substitutes the second portion of FIG. 16, an equivalent modification of the present invention as illustrated in FIG. 19 can be obtained.

Figure 20:
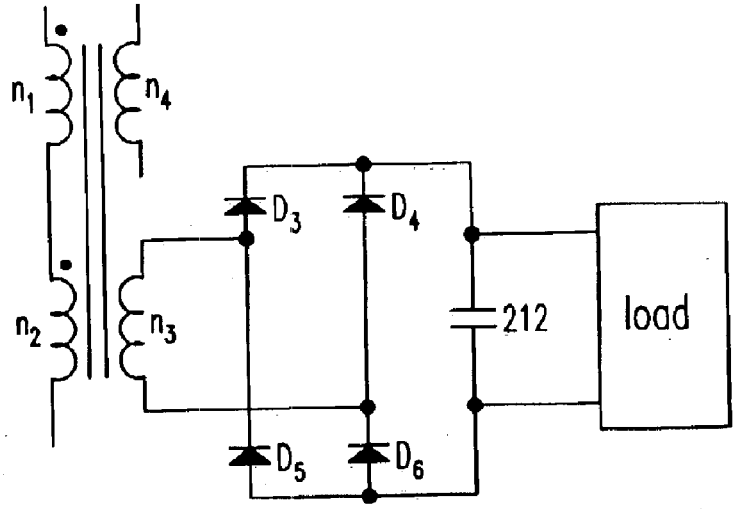
FIG. 20 is circuit schematic diagram of part of the DC/DC converter of the sixth embodiment of the present invention.

The sixth embodiment: The second portion of FIG. 16 is a full wave voltage doubler rectification. If a full bridge rectification substitutes the second portion of FIG. 16, an equivalent modification of the present invention as illustrated in FIG. 20 can be obtained.

Figure 21:
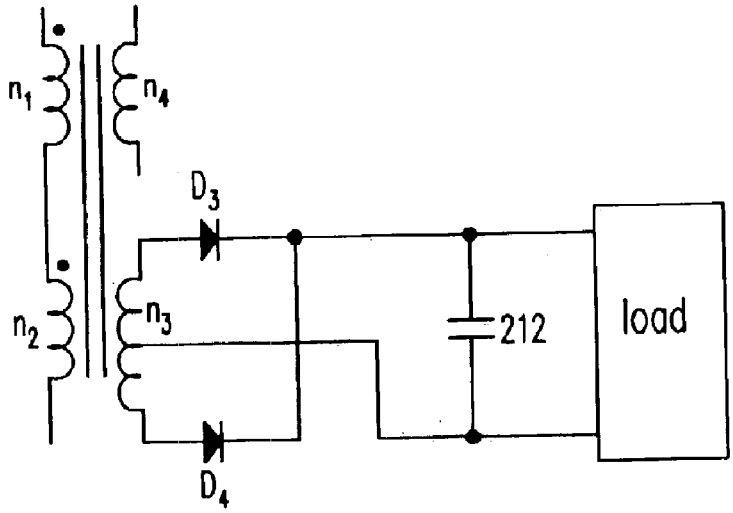
FIG. 21 is circuit schematic diagram of part of the DC/DC converter of the seventh embodiment of the present invention.

The seventh embodiment: The second portion of FIG. 16 is a full wave voltage doubler rectification. If a full wave rectification substitutes the second portion of FIG. 16, an equivalent modification of the present invention as illustrated in FIG. 21 can be obtained.

Figure 22:
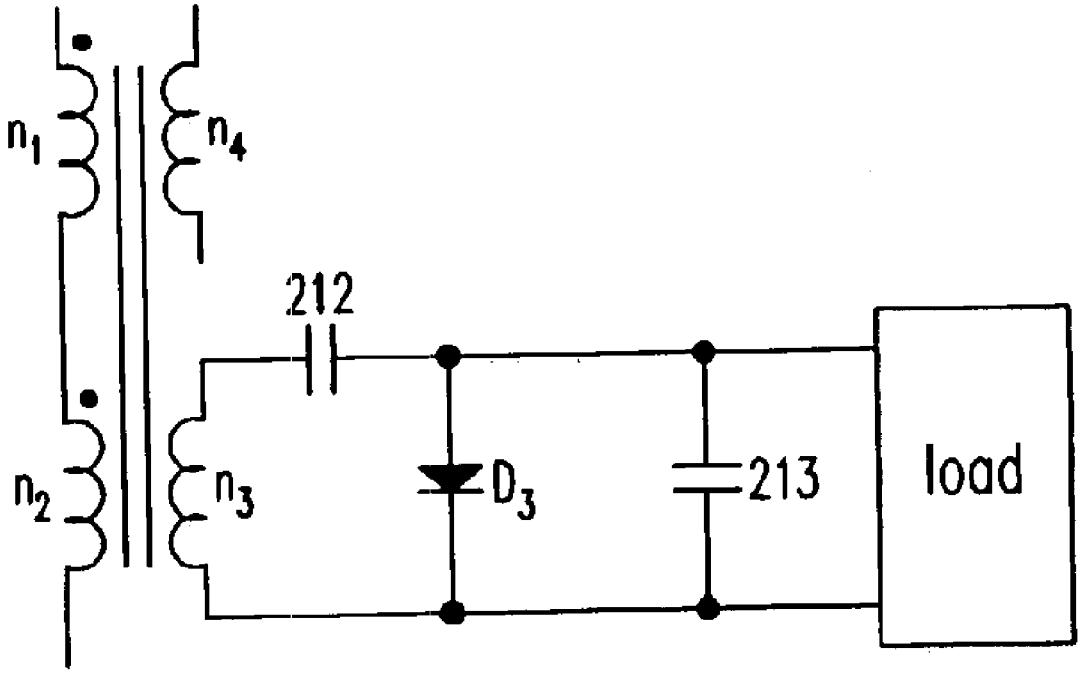
FIG. 22 is circuit schematic diagram of part of the DC/DC converter of the eighth embodiment of the present invention.

The eighth embodiment: The second portion of FIG. 16 is a full wave voltage doubler rectification. If another half wave rectification substitutes the second portion of FIG. 16, an equivalent modification of the present invention as illustrated in FIG. 22 can be obtained.

In conclusion, the present invention provides a magnetron high frequency device to decrease the DC bias of a magnetic flux of a high voltage transformer and to prevent the transformer from being operated under saturation state. Therefore, the present invention solves the problems of prior art and achieves the object of the present invention.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claim is:

1. A magnetron high frequency device comprises:

a filtering inductor coupled to a positive end of a direct current power supply and having a first end and a second end;

a central tap transformer having a central tap end, a first end and a second end, said central tap end being connected to said second end of said filtering inductor;

a filtering capacitor having a first end connected to said first end of said central tap transformer and a second end connected to a negative end of said direct current power supply;

a first switch which is connected in series to said second end of said central tap transformer and connected to said negative end of said direct current power supply;

an in-series circuit having a second switch and a second capacitor and coupled to said central tap transformer;

a first capacitor connected to said central tap transformer;

a rectifying device coupled to a secondary winding of said central tap transformer; and a magnetron coupled to said rectifying device, wherein, said first capacitor, said second capacitor and said central tap transformer forms a resonant circuit; and wherein said first capacitor is connected in-series with said central tap transformer and is connected in parallel with said first switch.

2. The magnetron high frequency device according to claim 1, wherein said first capacitor is connected in parallel with said central tap transformer.

3. The magnetron high frequency device according to claim 2, wherein said first capacitor is connected in parallel with said first end and said second end of said central tap transformer.

4. The magnetron high frequency device according to claim 1, wherein said first capacitor is connected in series with said second end of said central tap transformer.

5. The magnetron high frequency device according to claim 1, wherein said in-series circuit is connected in parallel with said central tap transformer.

6. The magnetron high frequency device according to claim 5, wherein said in-series circuit is connected in parallel with said first end and said second end of said central tap transformer.

7. The magnetron high frequency device according to claim 1, wherein said in-series circuit is connected in series with said central tap transformer.

8. The magnetron high frequency device according to claim 7, wherein said in-series circuit is connected in series with said second end of said central tap transformer.

9. The magnetron high frequency device according to claim 1, wherein said rectifying device is selected from a group consisting of a full wave voltage doubler rectification, a half wave voltage doubler rectification, a full wave rectification, and a full bridge rectification.

10. The magnetron high frequency device according to claim 1, wherein said transformer is a transformer with leakage inductance.

11. The magnetron high frequency device according to claim 1, wherein said first capacitor is a body capacitance of said first switch.

* * * * *